United States Patent [19]

Lange

[11] Patent Number: 4,750,739

[45] Date of Patent: Jun. 14, 1988

[54] PLYOMETRIC EXERCISING DEVICE

[76] Inventor: Olaf Lange, 2632 Walker, Carmel, Calif. 93923

[21] Appl. No.: 928,795

[22] Filed: Nov. 7, 1986

[51] Int. Cl.[4] ..... A63B 21/00

[52] U.S. Cl. ..... 272/130; 272/117; 272/123

[58] Field of Search ..... 272/117, 118, 123, 129, 272/130, 134, 142

[56] References Cited

U.S. PATENT DOCUMENTS

| | | | |
|---|---|---|---|
| 3,451,271 | 6/1969 | Knoblauch | 272/130 X |
| 3,524,644 | 8/1970 | Kane | 272/142 X |
| 3,998,100 | 12/1976 | Pizatella et al. | 272/129 X |
| 4,063,726 | 12/1977 | Wilson | 272/129 X |
| 4,357,010 | 11/1982 | Telle | 272/118 X |
| 4,540,171 | 9/1985 | Clark et al. | 272/123 X |
| 4,546,971 | 10/1985 | Raasoch | 272/118 |
| 4,564,194 | 1/1986 | Dawson | 272/134 X |

*Primary Examiner*—Richard J. Apley
*Assistant Examiner*—Robert W. Bahr
*Attorney, Agent, or Firm*—W. Edward Johansen

[57] ABSTRACT

The present invention is a plyometric exercising device which a hand bar for movement in opposite directions by a user, a bar guide which guides the movement of the hand bar, a gas supply and at least one cylinder which has a piston which is disposed within and attached to the bar guide and which is interconnected to gas supply. A switch activates the gas supply and is electrically connected to the gas supply. A switch activating mechanism activates the switch and is attached to the hand bar. The plyometric exercising device is operated by lifting the hand bar past the switch, which does not activate the switch and then lowering the hand bar past the switch, which activates the switch and causes compressed gas to flow into the at least one cylinder, which further causes the piston of the at least one cylinder to move downward, forcing the hand bar downward along with them with this sudden on-rush of compressed gas and concomitant force exerted thereby being halted once the hand bar moves further downward past the switch. The halting of the force causes the user to spring or "explode" upward in reaction thereto, thus developing explosive reactive power.

8 Claims, 2 Drawing Sheets a
b
c
d
e
2
6
14
16
20
22
24
46
48
50

PLYOMETRIC EXERCISING DEVICE

BACKGROUND OF THE INVENTION

1. Field of the Invention

The present invention relates generally to exercising devices and more specifically to a plyometric exercising device which enables the development of the user's explosive reactive power.

2. Prior Art

Plyometrics is the systematic training of explosive reactive power. This type of power is that utilized when jumping downward from an elevated position, landing and then springing upward. Upon landing, leg muscles will load or stretch, also referred to as eccentric muscular contraction. When springing upward after landing, the leg muscles "explode" or shorten, also referred to as concentric muscular contraction. It is "explosive" power that the present invention develops in a user by, in effect, causing the same muscular contractions that would occur if the user were to jump from an elevated position under more controlled and adjustable conditions. Nothing in the prior art teaches a device which even approaches the same purpose as the present invention.

Explosive reactive power is especially crucial to athletes involved in sports such as football, running and jumping. Football linesmen and sprinters, for example, must be able to "explode" off the line and starting block, respectively. A weak start can ruin an entire race for a runner. There has never been an exercising device that specifically addressed this need to develop explosive reactive power—until that of the present invention.

Numerous exercising devices have appeared on the market in response to the fitness craze which has swept the United States and has now reached many other parts of the world. Such devices range from simple hand weights held while jogging to weight bars upon which weights of varying heaviness can be added or subtracted, to elaborate weightlifting systems which fill entire rooms with apparatus. While some prior art exercising devices gradually increase the weight against which the user must exert similarly increasing muscular force, none provide the sudden force of the present invention, which force develops explosive reactive power.

Several pneumatic and hydraulic exercising devices can be found among the prior art. As an example, Keiser, U.S. Pat. No. 4,257,593, discloses a pneumatic exercising device employing a source of compressed gas which is controllable and is used for variable resistance. Devices such as those taught in the Keiser patent merely perform the same basic function as traditional weight devices: they exert passive resistive force which must be overcome by the user's muscular force. By increasing the magnitude of the resistive force applied by any of the prior art devices, either by increasing the hydraulic or pneumatic pressure or by simply adding more weights onto a weight type device, a user can develop greater muscular force. None of these devices in any way employ active resistive force to develop explosive reactive power.

The present invention fulfills the need for an exercising device which uses active resistive force to develop explosive reactive power, such feature being totally absent from all prior art devices. The present invention plyometric exercising device generates a sudden downward force upon a weightlifting bar as the user moves it downward across a switch. This force is generated when the switch activates a source of compressed gas, which is adjustable according to the pressure desired by the user. The gas then fills cylinders whose pistons are attached to the weightlifting bar and causes a downward pull on the bar.

SUMMARY OF THE INVENTION

The present invention comprises a plyometric exercising device having a weightlifting bar for upward and downward movement by a user, and which can accomodate weights at either end; a weightlifting bar guide with two vertical members each having an open channel to accomodate either end of the weightlifting bar; a cylinder in each vertical member of the weightlifting bar guide, inside of which there is a piston which slides within the cylinder and is attached to a piston rod which is further attached to the weightlifting bar; a switch attached to the weightlifting bar guide; a switch activator attached to the weightlifting bar; and a source of compressed gas which supplies gas to the cylinder when a solonoid valve is electrically activated by the switch. As gas fills the cylinders, the pistons of each cylinder are forced downward. This causes the piston rods and ultimately the weightlifting bar to be forced downward as well. Such downward force is applied to the weightlifting bar for as long as the switch activator is kept in contact with the switch while the bar is moved downward. By altering the length of the switch activator, the period of such downward force can be increased or decreased. By altering the pressure of the compressed gas via a pressure regulator, the magnitude of the force can be increased or decreased.

To operate the present invention plyometric exercising device, the user preferably stands between the vertical members of the weightlifting bar giude, squats down and grasps the weightlifting bar with both hands. As the user moves the bar first upward past the switch and then downward, when the switch activator trips the switch as it moves downward, gas suddenly enters the cylinders, causing the weightlifting bar to jerk downward. This phase of the exercise can be likened to jumping from an elevated position; it causes the leg muscles to load or stretch (eccentric muscular contraction) as the body is pulled downward by the weightlifting bar. Once the switch is cleared by the switch activator, the solonoid valve cuts off the supply of gas, thus relieving the weightlifting bar of the increased force and ultimately causing the user to "explode" upward as a reaction to this release. This phase of the exercise can be likened to springing up after jumping from an elevated position; it causes the leg muscles to shorten (concentric muscular contraction).

It is therefore an object of the present invention to provide a plyometric exercising device which develops explosive reactive power.

It is another object of the present invention to provide a plyometric exercising device which can be adjusted to increase or decrease the magnitude of the downward force exerted on the weightlifting bar by the compressed gas, as well as the duration of the period of such force.

It is still yet another object of the present invention to provide a plyometric exercising device which can be used in conjunction with standard weightlifting bars and weights, thus obviating that additional expense.

It is still yet another object of the present invention to provide a plyometric exercising device which allows for repetition of the exercise steps as many times as is desired by the user and at a pace set by the user.

The novel features which are believed to be characteristic of the invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only and are not intended as a definition of the limits of the invention.

DESCRIPTION OF THE PRESENTLY PREFERRED EMBODIMENT

Figure 1:
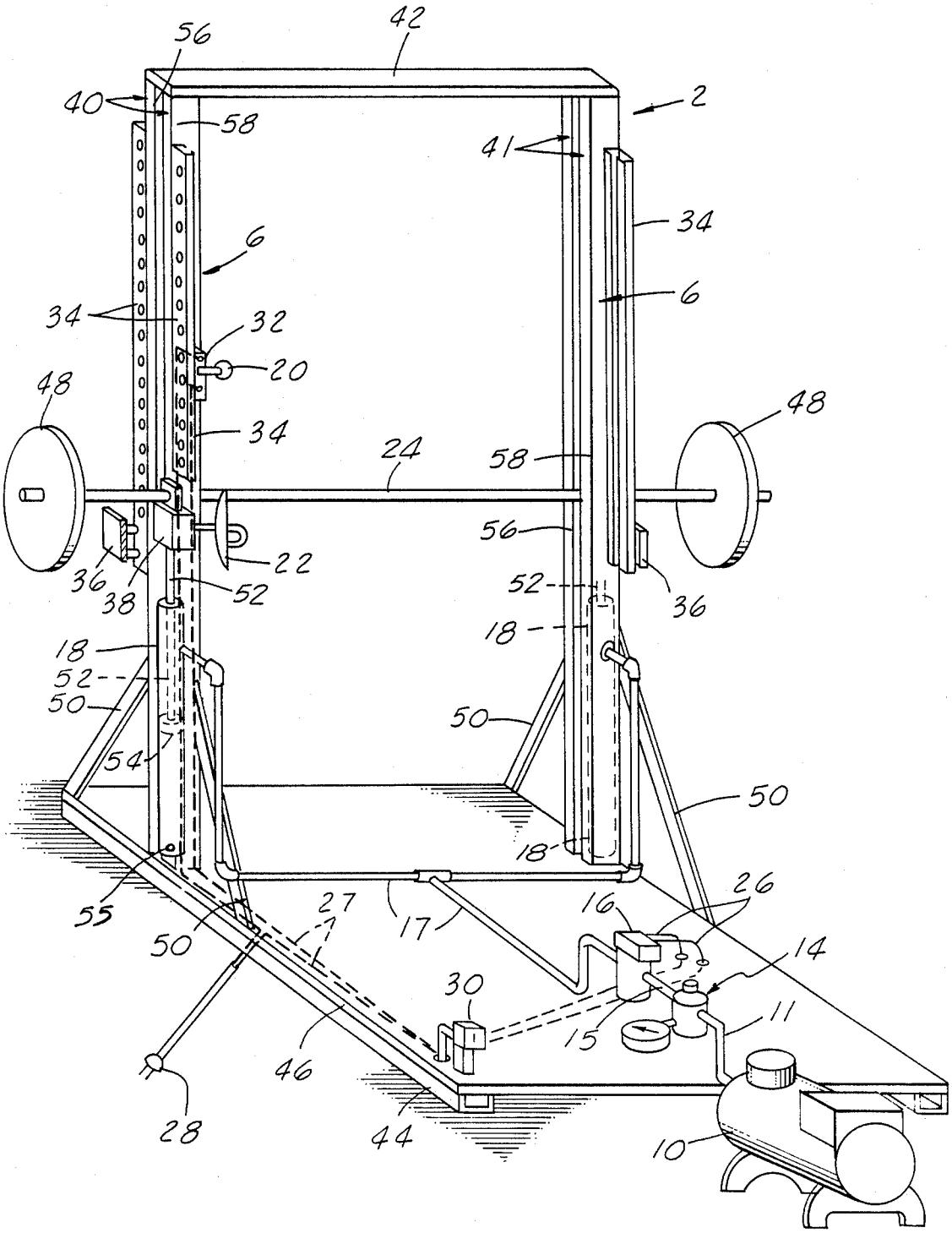
FIG. 1 is a pictorial view of a plyometric exercising device according to the present invention with a cutaway view of one of the cylinders.
Figure 2:
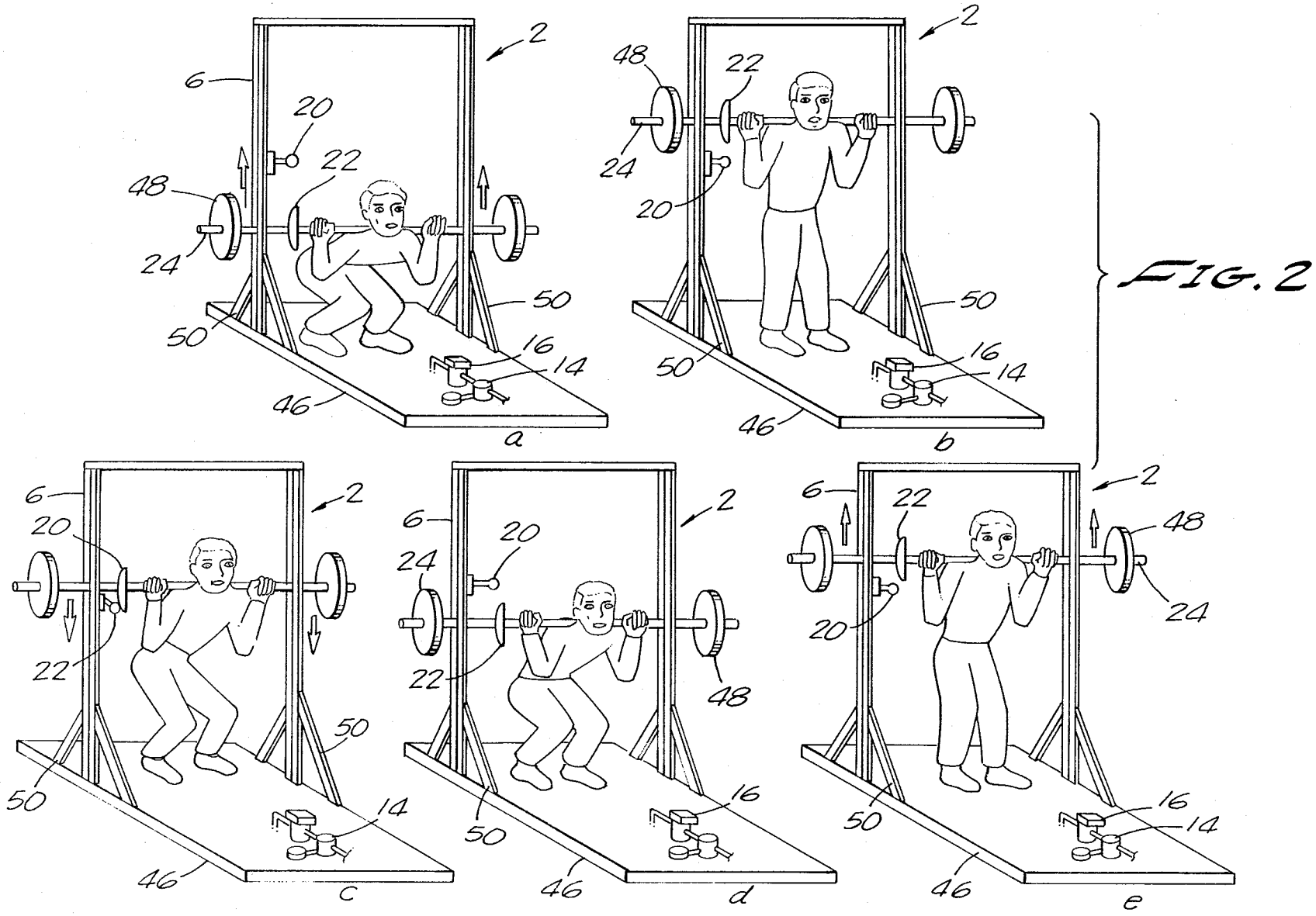
FIG. 2 is a series of drawings showing a plyometric exercising device according to the present invention in operation during the various stages of the plyometric exercise.

Referring more particularly to the drawings, the plyometric exercising device of the present invention is generally indicated by the numeral 2 in FIGS. 1 and 2. A pictorial view of the present invention is shown in FIG. 1. The present invention has a bar guide 6 within which a weightlifting bar 24 is moved by a user. Conventional weights 48 may be attached to the weightlifting bar 24 to provide added resistance to the user while exercising on the plyometric exercising device of the present invention. Weights 48 of any desired magnitude can be placed on the weightlifting bar 24 depending upon the strength of the user. By gradually increasing the number or heaviness of the weights 48 placed on the weightlifting bar 24, the weightlifting bar 24 will become increasingly more difficult to lift, and will ultimately strengthen the muscular power of the user.

In order to accomodate the weightlifting bar 24, the bar guide 6 is formed of two opposing vertical members 40, 41 spaced sufficiently apart so that the user can stand between them and lift the weightlifting bar 24 without having any part of his or her body touching them during the exercise. Each vertical member 40, 41 has an open channel formed by opposing slats 56, 58. Each end of the weightlifting bar 24 is placed within the open channel formed by slats 56, 58 of the two opposing vertical members 40, 41, thus allowing for movement of the weightlifting bar 24 by the user. A channel cover 42 prevents the weightlifting bar 24 from being lifted out of the plyometric exercising device 2 of the present invention.

Bar rests 36 allow the weightlifting bar 24 to be set down by the user after completion of the exercise. The bar rests 36 are attached to strut tracks 34 which allow the bar rests 36 to be placed at a desired height by the user. In such manner, the user can start the exercise routine from a desired position depending upon the height of the user.

A compressor 10, preferably an air compressor, is connected via an air line 11 to a pressure regulator 14. Pressure regulator 14 allows the user to select the desired air pressure which will ultimately be applied to weightlifting bar 24 as described below. Increasing the pressure will ultimately increase the force exerted upon weightlifting bar 24 and make the exercise more difficult for the user. Decreasing the pressure will have the opposite effect. From the pressure regulator 14, air then travels through air line 15 to a three-way solonoid valve 16 which either allows or blocks the flow of air from air line 15 depending upon whether the valve 16 is open or closed. The valve will open when electricity flows through it via electric wires 26.

Air lines 17 interconnect the solonoid valve 16 with two cylinders 18, each of which is placed within one of the vertical members 40, 41. Each cylinder 18 has a piston 54 slidably inserted into the cylinder 18 and a piston rod 52 attached to the piston 54. An air release 55 is provided toward the bottom of each cylinder 18. The air line 17 is connected to each cylinder 18 at a point above where each piston 54 is located. The outer end of each piston rod 52 is attached to the weightlifting bar 24.

Switch 20 is attached to switch height adjustment bolt 32, which is further attached to strut track 34 attached to slat 58 of one of the vertical members 40. This allows the switch 20 to be placed at a height selected by the user. A switch activator 22 is attached to a plate 38 which is in turn attached to weightlifting bar 24 on the same side of the bar guide 6 as is switch 20.

Switch is electrically connected via electric wires 27 to an electric safety lock 30. The electric safety lock 30 is provided to prevent the accidental activation of the device of the present invention, which occurrence could lead to injury of the user. Electric wires 26 connect the electric safety lock 30 to the solonoid valve 16. Electric plug 28 is provided along electric wires 27 in order for electricity to be supplied to the device of the present invention.

Frame 44 upon which a plywood, or other suitable material, flooring 46 sits is provided as a base for the plyometric exercising device of the present invention. Support beams 50 are braced against each of the vertical members 40, 41 to provide added support so that they may stand upright.

OPERATION

Operation of the plyometric exercising device of the present invention can best be understood by reference to FIGURE 2. Most of the structural details of the device of the present invention have been omitted from FIG. 2 for clarity. All references to the detailed structure of the device of the present invention apply to FIG. 1.

After plugging in the electric plug 28 and deactivating the electric safety lock 30, the user must then set the air pressure regulator 14 to the desired pressure. Once this is done, the user positions himself or herself behind the bar guide 6 and grasps the weightlifting bar 24, preferably resting the bar 24 on his or her shoulders, FIG. 2*a*. The user then pushes the weightlifting bar 24 upward past the switch 20, FIG. 2*b*. The weightlifting bar 24 can also be lifted by bench pressing technique. Though the switch activator 22 passes the switch 20 during this movement, the switch 20 has not yet been activated. The upward movement of the weightlifting bar 24 causes the pistons 54 to move upward through the cylinders 18, forcing the air above the pistons 54 out of the cylinders 18 and into air line 17. This air is ultimately released into the atmosphere through three-way solenoid valve 16, which, at this point, is still blocking the air from pressure regulator 14.

The user then squats down and causes the switch activator 22 to move the switch 20 downward which does activate the switch. Activating the switch 20 causes the solonoid valve 16 to simultaneously open to the air line 15 and close to the atmosphere and release air into air lines 17. Air from air lines 17 enters the cylinders 18 and causes the pistons 54 to move downward, forcing the air below the pistons 54 out of the cylinders 18 through air release 55. This downward movement of the pistons 54 in turn causes the piston rods 52 to pull downward on the weightlifting bar 24 at the pressure previously set by pressure regulator 14. FIG. 2*c*. By lengthening the switch activator 22, the air flow will be maintained for a longer period of time. Similarly, by shortening the length of the switch activator 22, the period of air flow will be decreased. Additionally, the switch 20 can be placed at a desired height by moving it along the strut track 34. This adjustment should be made in accordance with the height of the user.

For maximum plyometric effect, each piston 54 should be sufficiently large in diameter so as to be flush with the inner wall of each cylinder 18. To obtain a more gradual effect, the diameter of each piston 54 can be reduced allowing some air to pass by it and thus lessening the total force upon the pistons 54. This also makes it easier to stop during the phase of the exercise when compressed air is forcing the weightlifting bar 24 downward.

Once the switch activator 22 has moved completely past the switch 20 in the downward direction, the solonoid valve 16 is deactivated and stops the flow of air into air lines 17. FIG. 2*d*. At this point in the exercise cycle, the user stops momentarily in the squat position and then springs up out of the squat position. FIG. 2*e*. The sudden onset of additional pressure caused by the flow of air into the cylinders 18, which cause the weightlifting bar 24 to be jerked downward, followed by the sudden halt to such additional force, cause the user to spring or "explode" upward in reaction.

One cycle of the above-described exercise routine on the plyometric exercising device of the present invention can be likened to jumping from an elevated position. First, the leg muscles are loaded or stretched (eccentric muscular contraction) as the weightlifting bar 24 is suddenly pulled downward by the onset of the air flow. Then, the leg muscles of the user are shortened (concentric muscular contraction) as the air flow and the increased force created thereby is stopped.

A highly desirable advantage of the present invention is that it allows for repeated exercise cycles. After the user has "exploded", he or she again squats down, moving the switch activator 22 past the switch 20 in the downward direction thus activating the switch 20 and causing air to flow to the cylinders 18 and ultimately pull the weightlifting bar 24 downward. As this cycle is repeated, the user builds explosive reactive power.

By allowing for adjustment of the height of the weightlifting bar 24; by raising or lowering bar rests 36, the height of switch 20, the length of switch activator 22, and the amount of air pressure; and by adjusting pressure regulator 14, the present invention can be geared to the specific requirements of any given user. Adjustment of the switch 20 and the bar rests 36 allow users of different heights to use the device comfortably. Allowing for adjustment of switch activator 22 and pressure regulator 14 affords the user the flexibility of making the exercise cycle more strenuous or less strenuous. Such an adjustability allows for gradual build-up of explosive reactive power.

While the plyometric exercise is preferably done as described above, it can also be done from a bench press position. A bench can be placed under weightlifting bar 24 for the user to lay upon facing the weightlifting bar 24. The weightlifting bar 24 can be lowered to allow for such exercise. Switch 20 can also be lowered accordingly. The user grasps the weightlifting bar 24, presses it up past the switch 20, and then lowers it, tripping the switch 20 and causing the compressed air to force the weightlifting bar 24 downward. Once this additional force is halted as the switch activator 22 completely passes the switch 20 as it is moved downward, the user is caused to spring or "explode" upward with his or her arms. This bench press mode of using the present invention can thus further develop the explosive reactive power of the arms of the user.

I claim:

1. A plyometric exercising device comprising:

a hand bar for movement in opposite directions by a user;

bar guide means for guiding the movement of said hand bar;

gas supplying means;

at least one cylinder having a piston and disposed within said bar guide means, attached to said bar guide means and interconnected to said gas supplying means;

switch means for activating said gas supplying means, and electrically connected to said gas supplying means; and switch activating means for activating said switch means and attached to said hand bar wherein lifting said hand bar past said switch means does not activate said switch means, and then lowering said hand bar past said switch means activates said switch means and causes compressed gas to flow into said at least one cylinder, which further causes said piston of said at least one cylinder to move downward forcing said hand bar downward along with said piston, this sudden on-rush of compressed gas and concomitant force exerted thereby being halted once said hand bar moves further downward past said switch means wherein the halting of the force causes the user to spring or explode upward in reaction thereto, thus developing explosive reactive power.

2. A plyometric exercising device comprising:

a hand bar for upward and downward movement by a user;

bar guide means for guiding the movement of said hand bar;

gas supplying means;

at least one cylinder within said bar guide means having a piston rod attached to a piston, said piston being slidably inserted therein, with the outer end of said piston rod connected to said hand bar;

gas supplying means electrically connected to and activated by said switch means;

switch means for activating said gas supplying means and attached to said bar guide means;

switch activating means for activating said switch means when said hand bar is moved past said switch means, and attached to said bar guide means; and gas line means for channelling gas from said gas supplying means to said at least one cylinder and interconnected between said gas supplying means and said at least one cylinder wherein lifting said hand bar past said switch means does not activate said switch means, and lowering said hand bar past said switch means activates said switch means and causes compressed gas to flow into said at least one cylinder, which further causes said piston of said at least one cylinder to move downward forcing said hand bar downward along with said piston this sudden on-rush of compressed gas and concomitant force exerted thereby being halted once said hand bar moves further downward past said switch means wherein the halting of the force causes the user to spring or explode upward in reaction thereto, thus developing explosive reactive power.

3. The plyometric exercising device of claim 2 wherein a plurality of weights are attached to said hand bar at either end, making it more difficult for the user to lift said hand bar.

4. The plyometric exercising device of claim 2 wherein said bar guide means is comprised of two opposing vertical members spaced sufficiently apart so as to accomodate the user between them, with each said member having an open channel formed by two opposing slats, within which either end of said hand bar is placed, allowing for movement of said hand bar by the user; two bar rest means attached to both said vertical members, upon which said bar rests when not in use; and adjusting means to allow for placement of said bar rest means and said switch means at desired points along said bar guide means.

5. The plyometric exercising device of claim 4 wherein one said cylinder is affixed within each of said vertical members of said bar guide means, whereby each said cylinder accepts gas from said gas line at a point above said piston within said cylinder, with the pressure of such gas exerted upon said piston causing downward movement of said piston, further causing downward movement of said hand bar which is connected to each said piston of each said cylinder.

6. The plyometric exercising device of claim 2 wherein said switch means is activated only when moved in a downward manner and allows electricity to activate said gas supplying means for as long as it remains in a downward position.

7. The plyometric exercising device of claim 2 wherein said switch activating means can be of any desired length.

8. The plyometric exercising device of claim 2 wherein said gas supplying means is comprised of:

a gas compressor;

a gas pressure regulator connected to said gas compressor; and a solonoid valve connected to said gas pressure regulator, which valve is electrically connected to said switch means so as to permit the flow of gas to the at least one cylinder when said switch means is activated and halt the flow of gas to the at least one cylinder when said switch means is not activated.

* * * * *